US005957289A

United States Patent [19]

Negelen

[11] Patent Number: 5,957,289

[45] Date of Patent: Sep. 28, 1999

[54] LOCKING PAPERBOARD SLEEVE

[75] Inventor: Emanuel Negelen, Schweich, Germany

[73] Assignee: Riverwood International Corporation, Atlanta, Ga.

[21] Appl. No.: 08/930,022

[22] PCT Filed: Jan. 17, 1997

[86] PCT No.: PCT/GB97/00124

§ 371 Date: Jan. 26, 1998

§ 102(e) Date: Jan. 26, 1998

[87] PCT Pub. No.: WO97/28060

PCT Pub. Date: Aug. 7, 1997

[30] Foreign Application Priority Data

Jan. 31, 1996 [GB] United Kingdom ..... 9601896
Apr. 12, 1996 [GB] United Kingdom ..... 9607601

[51] Int. Cl.[6] ..... B65D 71/18

[52] U.S. Cl. ..... 206/434; 206/140

[58] Field of Search ..... 206/434, 429–431, 206/435, 427, 147, 152, 175, 140, 148; 53/398, 48.8–48.9

[56] References Cited

U.S. PATENT DOCUMENTS

| | | | |
|---|---|---|---|
| 3,963,170 | 6/1976 | Wood | 206/434 |
| 4,200,220 | 4/1980 | Ganz | 206/434 |
| 4,703,847 | 11/1987 | Oliff | 206/434 |
| 5,094,347 | 3/1992 | Schuster | 206/434 |
| 5,107,986 | 4/1992 | Cooper . | |
| 5,484,059 | 1/1996 | Sutherland | 206/434 |

FOREIGN PATENT DOCUMENTS

| | | |
|---|---|---|
| 0 271 056 A2 | 6/1988 | European Pat. Off. . |
| 0 615 920 A1 | 9/1994 | European Pat. Off. . |
| 2 647 755 | 12/1990 | France . |
| WO 93/02943 | 2/1993 | WIPO . |
| WO 94/22737 | 10/1994 | WIPO . |

*Primary Examiner*—Paul T. Sewell
*Assistant Examiner*—Luan K. Bui
*Attorney, Agent, or Firm*—Womble Carlyle Sandridge & Rice, PLLC

[57] ABSTRACT

A locking paperboard sleeve (11) for retaining at least a pair of spaced articles (12) is disclosed. The sleeve has a top panel (14), opposed side panels (15, 16) hingedly connected to the top panel, and first and second base panels (21, 22) constructed and arranged to interlock with one another and being hingedly fastened to one each of the respective side panels. A keel panel (37) is hingedly connected to the second base panel, and is constructed and arranged to be moved out of a common plane of the base panels, when locked together, and to be received between the at least two articles as a locking panel (26) hingedly connected to the first base panel is moved into locking engagement with the second base panel. The keel panel is retained in position between the at least two articles by a hook portion (34) extending from the locking panel which engages a notch (40) defined in the keel panel.

5 Claims, 5 Drawing Sheets

LOCKING PAPERBOARD SLEEVE

BACKGROUND OF THE INVENTION

This invention relates to paperboard devices for retaining a plurality of articles which taper inwardly toward their bases. An example of such an article is a pot of the type often used for dairy products such as yogurt, cream etc. When a sleeve is used to form a multipack of such articles, the heels of the articles require positive separation to retain pack integrity.

SUMMARY OF THE INVENTION

According to the present invention there is provided a paperboard retaining device for one or more pairs of articles arranged side by side in two rows, each article tapering inwardly towards its heel portion, the device having a top panel, oppositely disposed side panels hingedly connected to opposite edges of the top panel, and base panels hingedly connected to lower edges of the respective side panels, there being provided at least one locking device between the two base panels, which locking device comprises a primary lock and a secondary lock, in which comprises a locking panel connected to the first base panel by way of a first hinge, and which is substantially parallel to the hinge between the first base panel and its associated side panel, and a keel panel which is connected to the second base panel by way of a second hinge which is substantially perpendicular to the hinge between the second base and its associated side panel. The keel panel is constructed and arrange to be moved out of the general plane of the base into a raised position so as to be located between a pair of adjacent articles, and the locking panel hinged upwardly so that formations on the locking panel and keel panel interlock so as to be retained in their raised positions.

Preferably the locking panel extends through the space vacated by the keel panel which is moved into its raised position by the locking panel. With certain arrangements said cooperating formations of the secondary lock comprise a hook portion on the first locking panel and a notch formed in the keel panel.

In preferred arrangements the primary lock comprises interlocking elements located on the two base panels. Conveniently the interlocking elements comprise an edge formed in the second base panel by virtue of cut and a locking tab formed on the first base panel between two aligned third hinges which are parallel to the first hinge, the tab being connected to a second locking panel which extends between the first and third hinges, and in use is engaged behind said edge.

Preferably a further lock is provided to prevent the secondary lock from opening once engaged. In one embodiment a further hook portion is provided on the first locking panel adjacent the second locking panel, which further hook position engages in an additional cut defined in the second base panel.

A preferred feature is that the keel panel has a further hinge, parallel to the second hinge, thereby defining an angled part and a free part of the keel panel remote from the second hinge, which free part in use is in a plane substantially parallel to the general plane of the base of the device. Also, the angled part and the free part of the keel panel are contoured so as to follow the contours of the articles which are engaged by keel panels. Another feature is that the cooperating notch is formed in the angled part of the keel panel.

Ideally a locking device is provided between each adjacent pair of articles, and also location arrangement are provided for the heels and/or tops of the articles, which location means may be in the form of apertures or slots.

DESCRIPTION OF THE DRAWINGS

The description makes reference to the accompanying drawings in which.

DETAILED DESCRIPTION OF THE PREFERRED EMBODIMENTS

Figure 1:
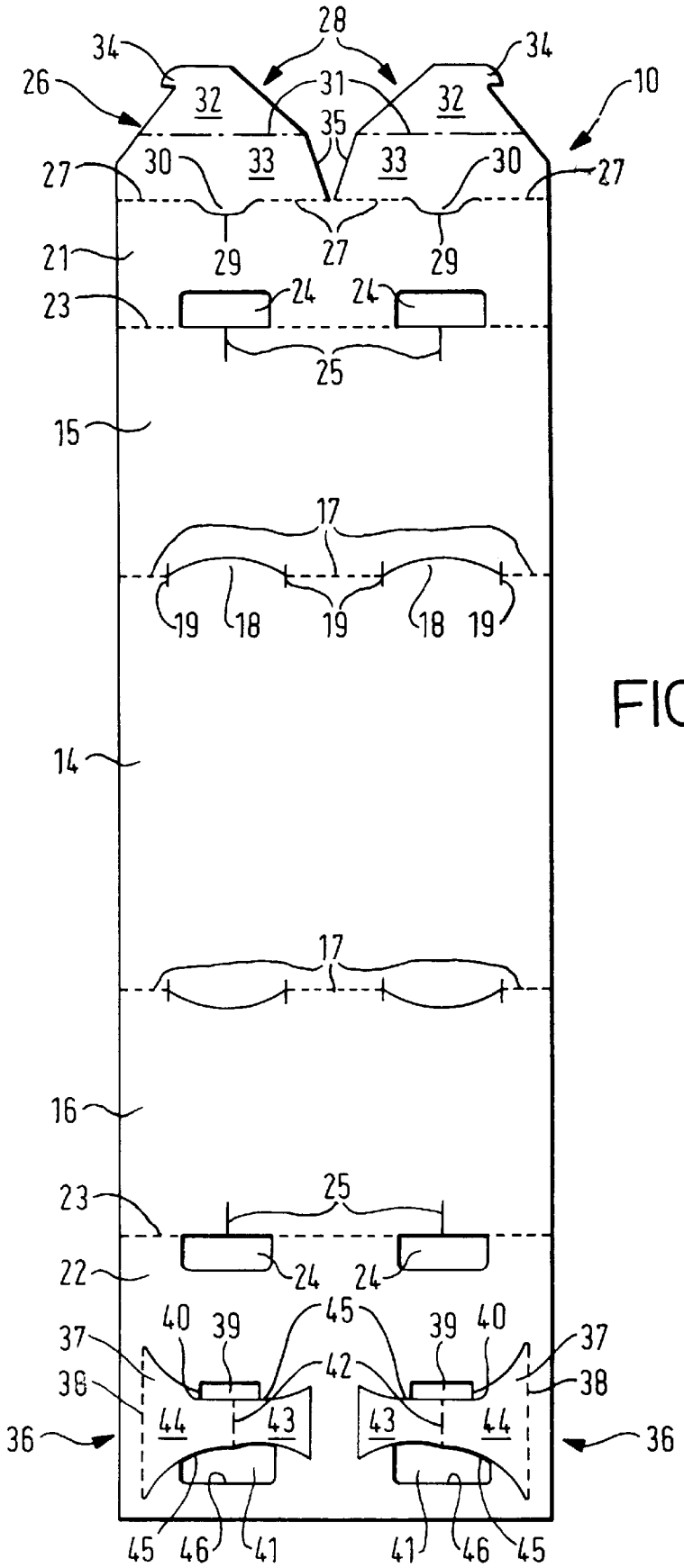
FIG. 1 is a plan view of a paperboard blank for forming a device according to the present invention.
Figure 2:
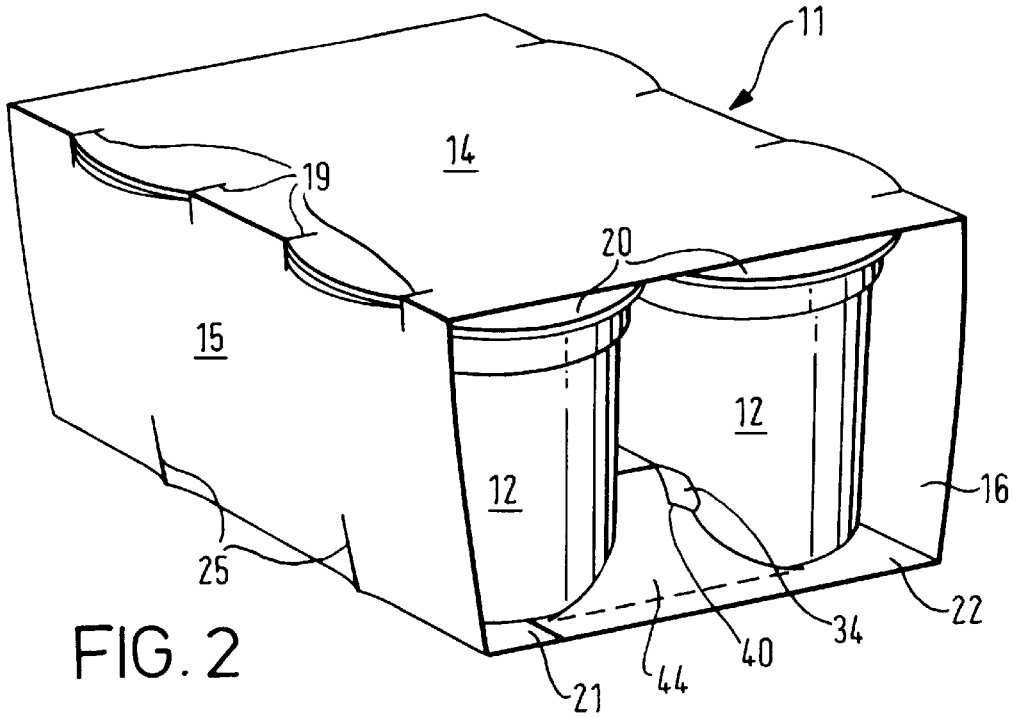
FIG. 2 is a perspective view form above the device of the present invention in use.
Figure 3:
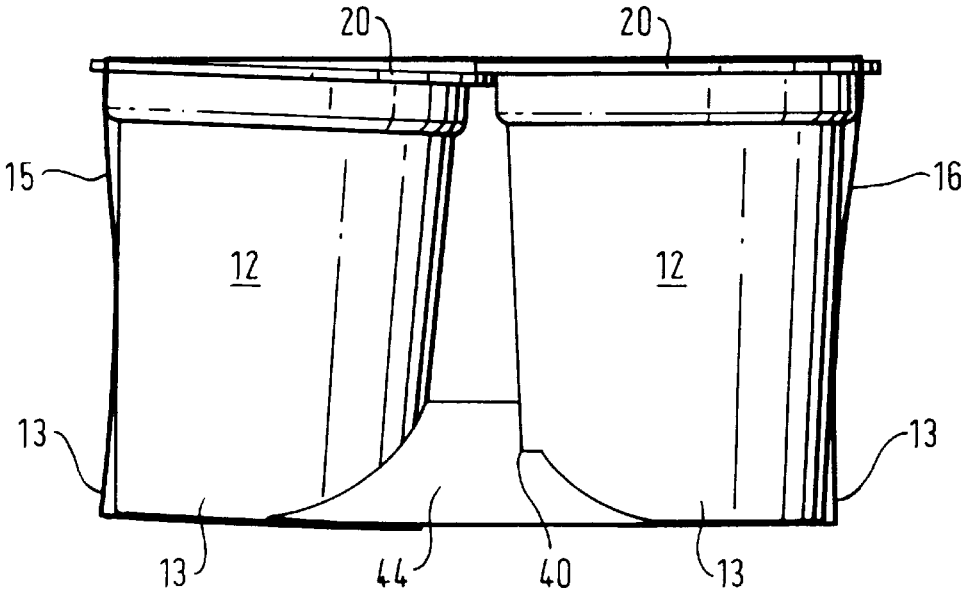
FIG. 3 is an end elevational view of the FIG. 2 arrangement.

In the figures there is shown a paperboard blank 10 (FIG. 1) for forming a device in the form of a sleeve 11 (FIG. 2) retaining a multipack of articles 12 which taper inwardly towards their heel portions 13 (FIG. 3). In the embodiment shown there are two rows of two articles 12 which are in the form of pots for containing dairy products such as yogurt, cream, and the like. Other products can be contained in the pots, and other arrays apart from 2×2 can be accommodated.

The blank 10 comprises a top panel 14, which is hingedly connected at opposite side edges to side panels 15, 16 along fold portions 17. Cooperating sets of arcuate cuts 18 and transverse cuts 19 constitute formations for locating and retaining top flanges 20 of the pots 12.

First and second base panels 21, 22 are hingedly connected to the respective side panels 15, 16 along folds 23. A rectangular aperture 24 is provided for each pot 12 in one of the base panels 21, 22 from the aperture 24 for a short way up the associated side panel 15, 16. Each cut 25 and aperture 24 combination constitutes an arrangement for receiving the heel portion 13, a pot 12 when the device 11 is assembled.

The first base panel 21 incorporates a locking panel 26 which is connected to the remainder of the first base panel 21 by a hinge 27 which is parallel to the fold 23 between the first base panel 21 and the side wall 15. In this embodiment the locking panel 26 comprises two locking portions 28 which are independently movable about hinge 27. The operation of each locking portion 28 is identical and so the operation and composition of only one will be described.

For each locking portion 28, the hinge 27 is in two sections between which is an arcuate cut 29 across which the hinge 27 does not extend. The cut 29 results in the locking panel having a tab 30 projecting towards the side panel 15. Each locking portion 28 also has another hinge 31 (the first hinge) which is parallel to the hinge 27 (the third hinge), thereby dividing the locking portion 28 into a first locking panel 32 and a second locking panel 33. The first locking panel 32 tapers inwardly towards its end remote from the first hinge 31 and is formed at its free end with a hook portion 34. Also the inside edges 35 of the second locking panel 33 are angled away from each other, meeting at the location of the third hinge 27.

The second base panel 22 incorporates a pair of keel portions 36 which cooperate with the respective locking portions 28 of the first base panel 21. Each keel portion 36 comprises a keel panel 37 which is hingedly connected to the second base panel 22 along a second hinge 38 which is transverse compared to the hinge 23 between the second base panel 22 and the side panel 16. Each keel portion 36 also provides a small rectangular opening 39 which defines a locking notch 40 in the keel panel 37 and a further opening 41 which provides a locking edge 46.

Each keel panel 37 has a further hinge 42 which subdivides the keel panel 37 into a free part 43 and an angled part 44 (which is so called because of its disposition in use). The side edges 45 of the keel panel 37 are curved for reasons which will be explained later.

Assembly of the device 11 will now be described with particular reference to FIGS. 4 to 8.

Figure 4:
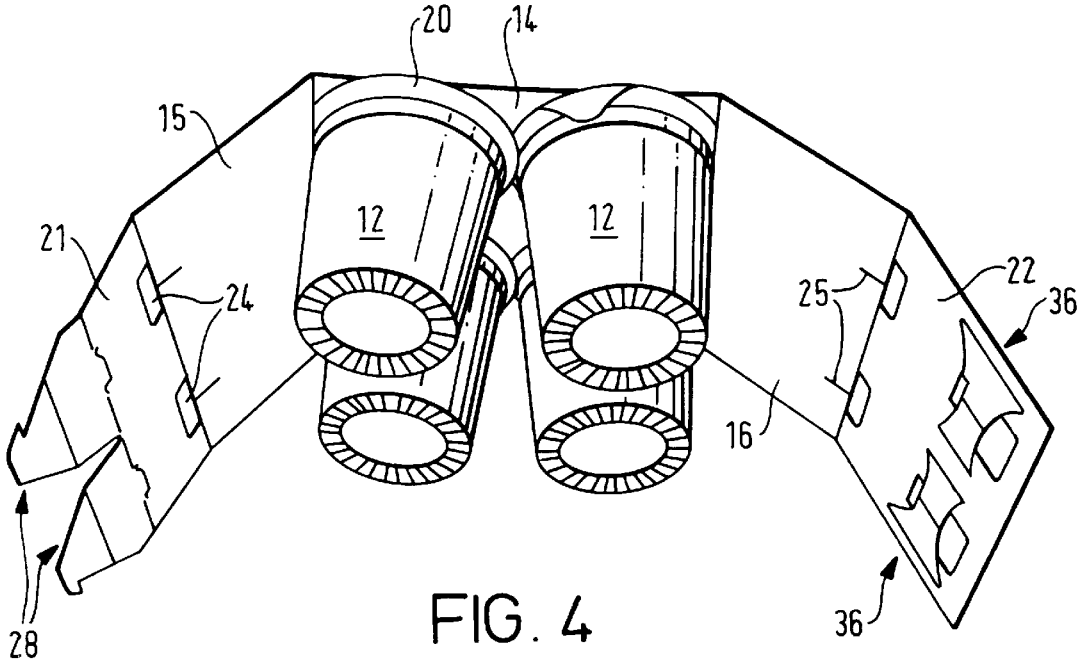
FIGS. 4 to 8 are sequential perspective views from below the device showing the assembly of the device.
Figure 5:
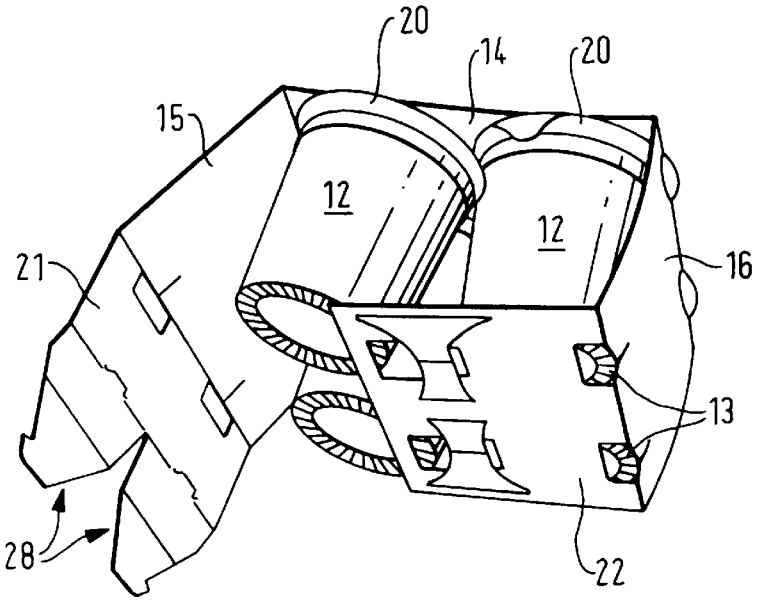
Figure 6:
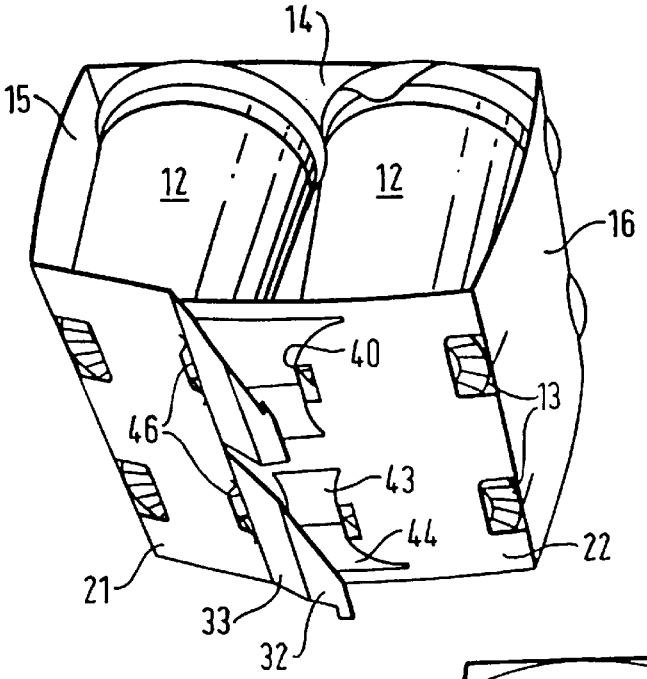
Figure 7:
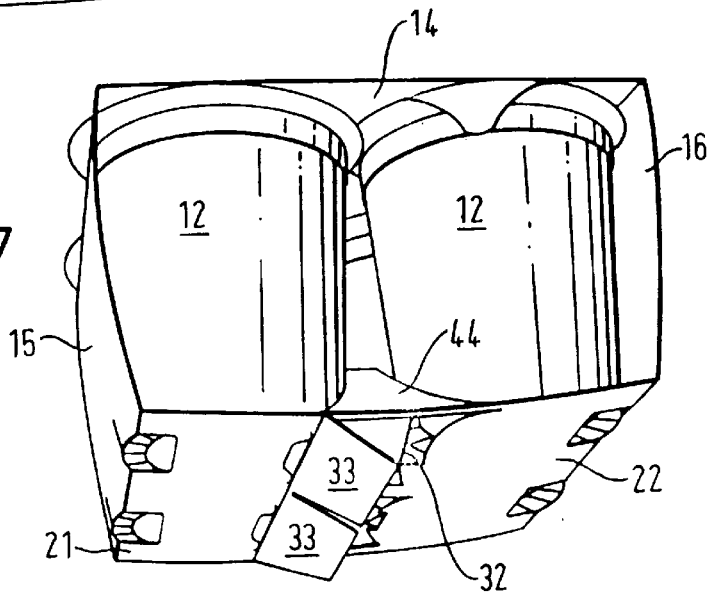
Figure 8:
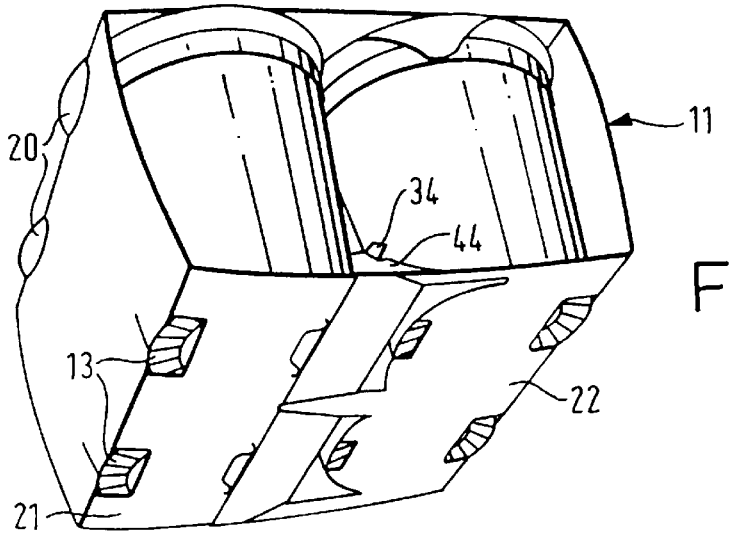

Firstly four pots 12 are arranged in a 2×2 array with the top flanges 20 overlapping so as to improve the stability of the array when held in the finished device 11. This overlapping is clear from FIG. 3. The blank 10 is then placed on the pots with the top panel 14 lying against the tops of the pots 12 as shown in FIG. 4. The side panels 15, 16 are then swept down and the second base panel 22 is folded under the pots 12 as is shown in FIG. 5.

The locking portions 28 are then folded about the third hinge 27 away from the pots so that the tabs 30 stand clear of the remainder of the first base panel 21. The tabs 30 are then inserted into the opening 41 and engage the respective locking edges 46. This constitutes the primary lock of the device 11 and rotation of the locking portions 28 back towards the pots 12 helps to tighten the blank 10 around the array of pots 12.

Each first locking panel 32 is then hinged about the first hinge 31 towards the pots 12 such that the free end of each first locking panel 32 engages the angled part 44 of the associated keel panel 37 adjacent the notch 40. The first locking panel is then urged upwards and inwards between the adjacent pair of pots 12 through the space left by the hinging of the keel panel. This causes the keel panel 37 to rise between the pots 12 with the free part 43 tending to hinge about the further hinge 42 and remain generally parallel to the overall plane of the base of the device 11.

At a certain point the angled part 44 has hinged sufficiently about the second hinge 38 for the hook portion 34 of the first locking panel 32 to pass the notch 40. The resilience of the paperboard causes the angled part 44 to snap back below the hook portion 34. This constitutes the secondary lock of the device 11 in addition to providing the device with a keel.

The dimensions of the blank 10 are such that when the secondary lock is made, the second locking panel lies substantially flat along the base of the device. Also the size of the keel panel and its shaped edges 45 ensure that it is a snug fit between the pots 12 which tend to cause the areas of the side panels 15, 16 adjacent the cuts 25 to bulge slightly, thereby aiding the retention of the pots in the sleeve 12. The curved edges 45 also prevent movement of the pots forwards and backwards in the direction of the open ends of the sleeve as well as preventing transverse movement of the pots in the direction of the side walls.

Figure 9:
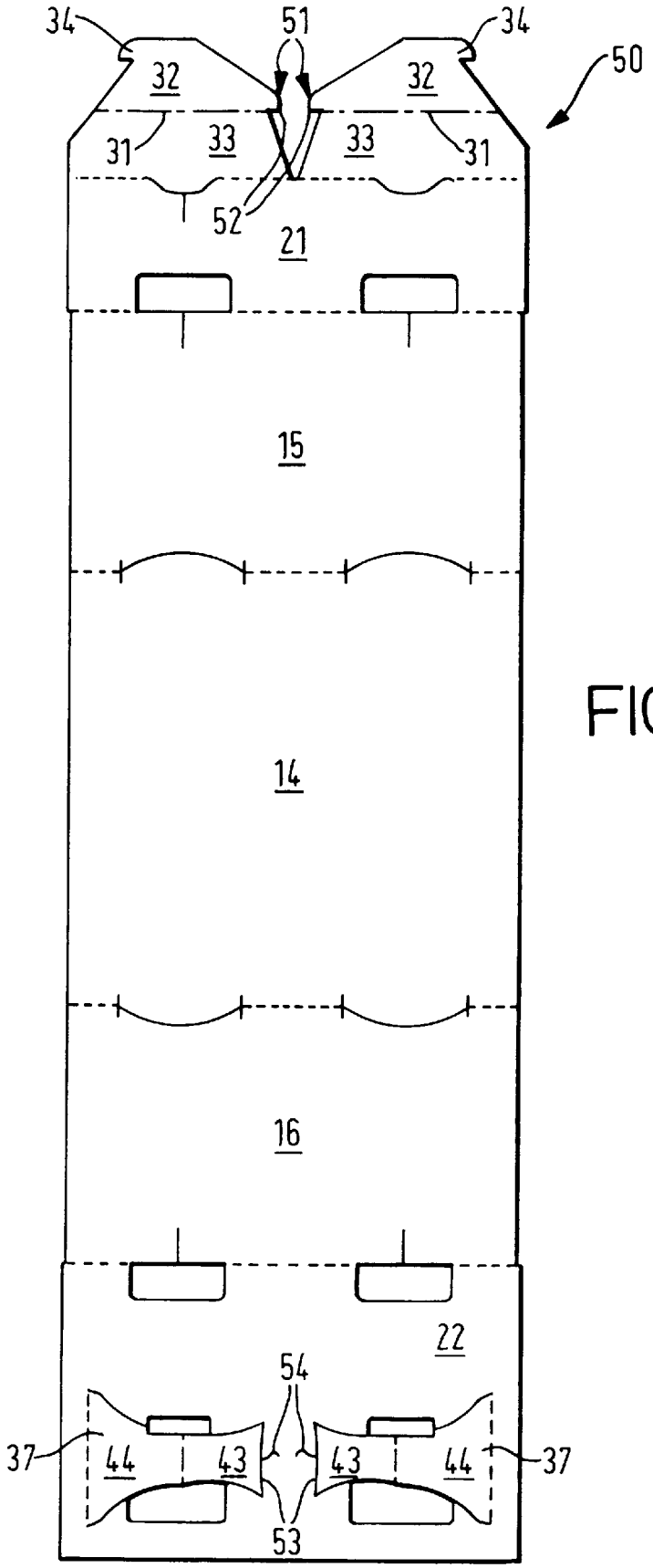
FIG. 9 is a plan view of a paperboard blank for forming a second embodiment of device according to the present invention.

In FIG. 9 there is shown a modified blank 50. It is similar in most respects to the blank 10 of FIG. 1 and so like features have been given like reference numerals. The blank 9 has the additional features of a further hook portion 51 being provided at the lower edge of each first locking panel 32, a hook edge 52 extending from the first hinge 31. The further hook portion 51 is located on the opposite side of the first locking panel to hook portion 34.

Also each lateral cut 53 in the second base panel 22, which lateral cut defines the inner edge of each free part 43 of the keel panel 37 is provided with an additional cut 54 which is generally of curled form extending in a generally lengthwise direction. When assembled the further hook portions 51 engage in the respective additional cuts 54 to prevent the lock from pushing back open.

It will be understood that the precise form of the further hook portions 51 and the additional cuts 54 are a matter of design choice.

It will be appreciated that the precise shape and size of the keel panels and locking portions are a matter of design choice. For example, more or less tabs 30 could be provided to form the primary lock. It is even possible that the primary lock features described above could be omitted with the primary lock being formed by an adhesive connection of the two base panels.

Also the heel retention and flange retention methods described above are shown as examples of suitable designs and could be replaced, modified or even omitted.

Although reference has been made to tapering articles, it is to be understood that the term covers other articles which are narrower at the heel than at the top. For example, straight sided pots having a wider top flange could also utilise the type of sleeve described above.

While preferred embodiments of the invention have been disclosed in the foregoing specification, it is understood by those skilled in the art that the variations and modifications thereof can be made without departing from the spirit and scope of the invention, as set forth in the following claims.

I claim:

1. A paperboard retaining device for holding at least one pair of contoured articles in a side by side relationship with respect to one another in two parallel rows, comprising:

a top panel having a first side edge and a spaced and parallel second side edge;

a first side panel having a lower edge and being hingedly connected to the top panel along said first side edge;

a second side panel having a lower edge and being hingedly connected to the top panel along said second side edge;

a first base panel hingedly connected to the lower edge of the first side panel;

a second base panel hingedly connected to the lower edge of the second side panel;

a locking assembly comprised of a first lock and a second lock for locking said first base panel and said second base panel together to form a base comprised of said first base panel and said second base panel, said first lock formed as a part of said first base panel and comprising a locking panel moveable along a first hinge spaced from and substantially parallel to the lower edge of the first side panel; and a keel panel formed as a part of said second base panel and moveable along a second hinge spaced from and substantially perpendicular to the lower edge of the second side panel, wherein said keel panel is selectively moveable out of a plane generally parallel to said base formed when said first and second base panels are locked together and into a raised position above said plane so as to be positioned between two of the articles, and wherein said locking panel is moveable to a position adjacent said keel panel so that said locking panel and said keel panel interlock to retain the keel panel in said raised position, wherein said second lock includes an edge defined in said second base panel by a cut, and said first lock includes a locking tab defined on the locking panel along a third hinge, said locking tab being formed as a part of a second locking panel defined in said first base panel by said first hinge and said third hinge which is spaced from and parallel to said first hinge, said tab being sized and shaped to be received behind said edge when said first base panel and said second base panel are interlocked with one another, and wherein said keel panel includes a fourth hinge parallel to said second hinge, said fourth hinge dividing said keel panel into an angled part between said second hinge and said fourth hinge, and a free part extending away from said fourth hinge.

2. The retaining device of claim 1, wherein said angled part and said free part have contoured side edges sized and shaped to follow the contours of the articles engaged by said keel panel.

3. The retaining device of claim 1, wherein a locking notch is defined in the angled part of the keel panel.

4. A locking paperboard sleeve for retaining at least one pair of articles in a side by side relationship with respect to one another in two parallel rows, each article having a contoured side wall tapering inwardly toward a heel portion on which the article stands and a spaced top, said sleeve comprising:

a top panel having a first side edge and a spaced, parallel second side edge;

a first side panel having a lower edge and being hingedly connected to the top panel along said first side edge;

a second side panel having a lower edge and being hingedly connected to the top panel along said second side edge;

a first base panel hingedly connected to the lower edge of the first side panel spaced from and parallel to said first side edge;

a second base panel hingedly connected to the lower edge of the second side panel spaced from and parallel to said second side edge; and a locking assembly for locking said first base panel and said second base panel together, said locking assembly including:

at least one locking panel hingedly connected to said first base panel along a first hinge line, said first hinge line being spaced from and parallel to the lower edge of said first side panel; and at least one keel panel hingedly fastened to said second base panel along a second hinge line, said second hinge line being spaced from and perpendicular to the lower edge of said second side panel, said keel panel selectively moveable above a plane formed by said first base panel and second base panel when said first base panel and said second base panel are locked together, so that said keel panel is positioned between the respective articles, thereby positioning the articles with respect to one another, wherein said locking panel includes a third hinge line spaced from and parallel to said first hinge line, said third hinge line dividing said locking panel into a first hinged locking panel extending away from the third hinge line, and a second hinged locking panel defined between said first and said third hinge lines, said first locking panel also including a hook portion, said hook portion being sized and shaped to be received by a locking notch defined adjacent said keel panel, and wherein said keel panel includes a fourth hinge line spaced from and parallel to said second hinge line, said fourth hinge line dividing the keel panel into an angled part defined between said second and said fourth hinge lines, and a free part extending away from said fourth hinge line.

5. The locking paperboard sleeve of claim 4, wherein said angled pa and said free part each have spaced and contoured side edges sized and are shaped to follow the contours of at least one pair of articles retained within said paperboard sleeve.

* * * * *